US009220329B1

(12) United States Patent
Kim et al.

(10) Patent No.: US 9,220,329 B1
(45) Date of Patent: Dec. 29, 2015

(54) PACKAGING FOR HAIRPIECES

(71) Applicant: SHAKE-N-GO FASHION, INC., Port Washington, NY (US)

(72) Inventors: James K. Kim, Manhasset, NY (US); Peter Ough, Bayside, NY (US); Hye Sun Kim, Port Washington, NY (US)

(73) Assignee: Shake-N-Go Fashion, Inc., Port Washington, NY (US)

( * ) Notice: Subject to any disclaimer, the term of this patent is extended or adjusted under 35 U.S.C. 154(b) by 0 days.

(21) Appl. No.: 14/488,768

(22) Filed: Sep. 17, 2014

(51) Int. Cl.

| | |
|---|---|
| ***B65D 85/18*** | (2006.01) |
| ***A45C 11/00*** | (2006.01) |
| ***A41G 5/00*** | (2006.01) |
| ***A45D 44/00*** | (2006.01) |

(52) U.S. Cl.
CPC . *A45C 11/00* (2013.01); *A41G 5/00* (2013.01); *A45D 44/00* (2013.01); *B65D 85/18* (2013.01)

(58) Field of Classification Search
CPC ..... B65D 85/66; B65D 85/18; A41G 5/00; A41G 5/004; A41G 5/0053; A41G 5/0073; A41G 5/0026
USPC ..... 206/8, 225, 389, 397, 398, 410, 415, 206/413, 414, 416, 407, 581
See application file for complete search history.

(56) References Cited

U.S. PATENT DOCUMENTS

| | | | | |
|---|---|---|---|---|
| 122,183 | A | 12/1871 | Mayer | |
| 289,957 | A | 12/1883 | Baxter | |
| 1,968,262 | A | 7/1934 | Prosser | |
| 2,343,124 | A | 2/1944 | Larison | |
| 5,722,434 | A | 3/1998 | Walker | |
| D644,426 | S | 9/2011 | Skaggs | |
| 8,439,237 | B2 * | 5/2013 | Choi | 223/24 |
| 8,590,543 | B2 | 11/2013 | Goff et al. | |
| 2006/0065280 | A1 | 3/2006 | Cheung | |
| 2009/0165810 | A1 | 7/2009 | Sotokawa et al. | |
| 2011/0284397 | A1 | 11/2011 | Batres et al. | |
| 2013/0206628 | A1 | 8/2013 | Batres et al. | |

FOREIGN PATENT DOCUMENTS

WO 2010/027187 A2 3/2010

* cited by examiner

*Primary Examiner* — Jacob K Ackun
*Assistant Examiner* — Jenine Pagan
(74) *Attorney, Agent, or Firm* — Greenberg Traurig, LLP

(57) ABSTRACT

A packaging includes an elongated member having a first end and a second end opposite the first end. The elongated member is elongated along a longitudinal axis between the first and second ends. At least one hair product having a plurality of hair strands is wound around the elongated member. The packaging also includes at least one wrap wound around the elongated member over the hair strands so as to keep the hair strands wound around the elongated member.

14 Claims, 8 Drawing Sheets

PACKAGING FOR HAIRPIECES

FIELD OF THE INVENTION

The present invention relates to packaging for hairpieces and, more particularly, to packaging adapted for maintaining the style of hairpieces placed therein.

BACKGROUND OF THE INVENTION

Many people, particularly women, utilize hairpieces, such as hair extensions, wigs and weaves, to provide themselves with new and different hairstyles. Various hairstyles involve the use of curled hair. The present invention provides a packaging for hairpieces for maintaining the style of hairpieces placed therein.

SUMMARY OF THE INVENTION

In accordance with an embodiment of the present invention, a packaging includes an elongated member having a first end and a second end opposite the first end. The elongated member is elongated along a longitudinal axis between the first and second ends. At least one hair product having a plurality of hair strands is wound around the elongated member. The packaging also includes at least one wrap wound around the elongated member over the hair strands so as to keep the hair strands wound around the elongated member.

In accordance with another embodiment of the present invention, a method of assembling a hair packaging includes the steps of providing an elongated member having a first end and a second end opposite the first end, the elongated member being elongated along a longitudinal axis between the first and second ends; and providing at least one hair product having a plurality of hair strands. The method also includes the steps of winding the plurality of hair strands of the at least one hair product around the elongated member; and winding at least one wrap wound around the elongated member over the plurality of hair strands so as to keep the plurality of hair strands wound around the elongated member.

BRIEF DESCRIPTION OF THE DRAWINGS

For a more complete understanding of the present invention, reference is made to the following detailed description of the invention considered in conjunction with the accompanying drawings, in which.

DETAILED DESCRIPTION OF EMBODIMENTS OF THE INVENTION

Figure 1:
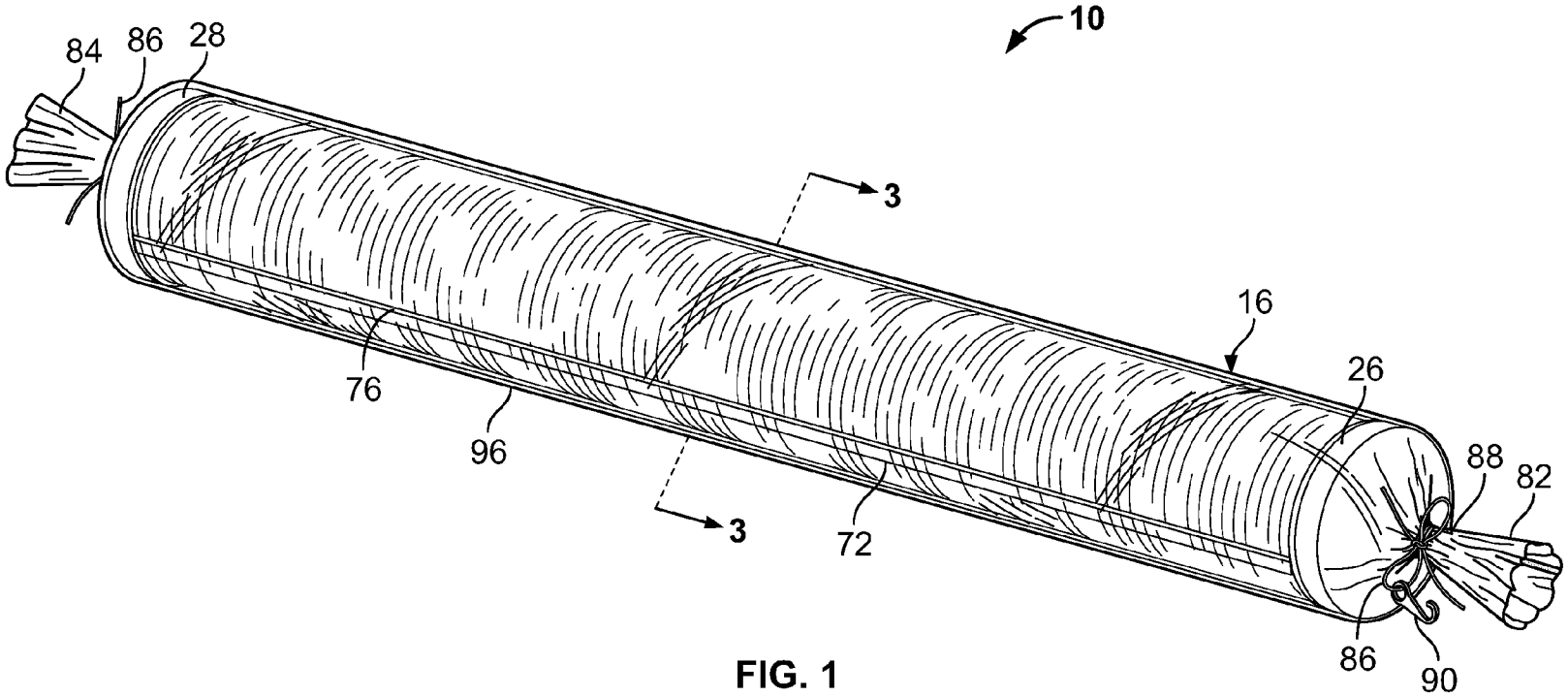
FIG. 1 is a front perspective view of a hair packaging constructed in accordance with an embodiment of the present invention.

Various embodiments are disclosed herein; however, it is to be understood that the disclosed embodiments are merely illustrative of the disclosure that can be embodied in various forms. In addition, each of the examples given in connection with the various embodiments is intended to be illustrative, and not restrictive. Further, the figures are not necessarily to scale, some features may be exaggerated to show details of particular components (and any size, material and similar details shown in the figures are intended to be illustrative and not restrictive). Therefore, specific structural and functional details disclosed herein are not to be interpreted as limiting, but merely as a representative basis for teaching one skilled in the art to variously employ the disclosed embodiments.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; exemplary embodiments are provided merely to be illustrative. Among other things, for example, subject matter may be embodied as methods, devices, components, combinations or systems. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context. Moreover, directional and positional phrases, such as "upper", "lower", "lateral", "bottom", "top", "front", "rear", "downwardly", "upwardly", "laterally", "axially", etc., are used herein for illustration purposes only and should not be construed as limiting the scope of the present invention.

Although the present invention can be used in conjunction with any type of hair products, it is particularly suitable for use in connection with a hair extension product. Accordingly, the present invention will be described below in connection with such a hair product. It should be understood, however, that the following description is only meant to be illustrative of the present invention and is not meant to limit the scope of the present invention, which has applicability to other hair product types, including wigs and other hairpieces With reference to FIG. 1, there is shown a hair packaging 10 constructed in accordance with an embodiment of the present invention. The hair packaging 10, when fully assembled as show in FIG. 1, include a base 12, an inner wrap 14 and an outer wrap 16 for packaging one or more hair extensions 18 therein (see FIG. 2). The components of the hair packaging 10 will be discussed in detail below.

Figure 2:
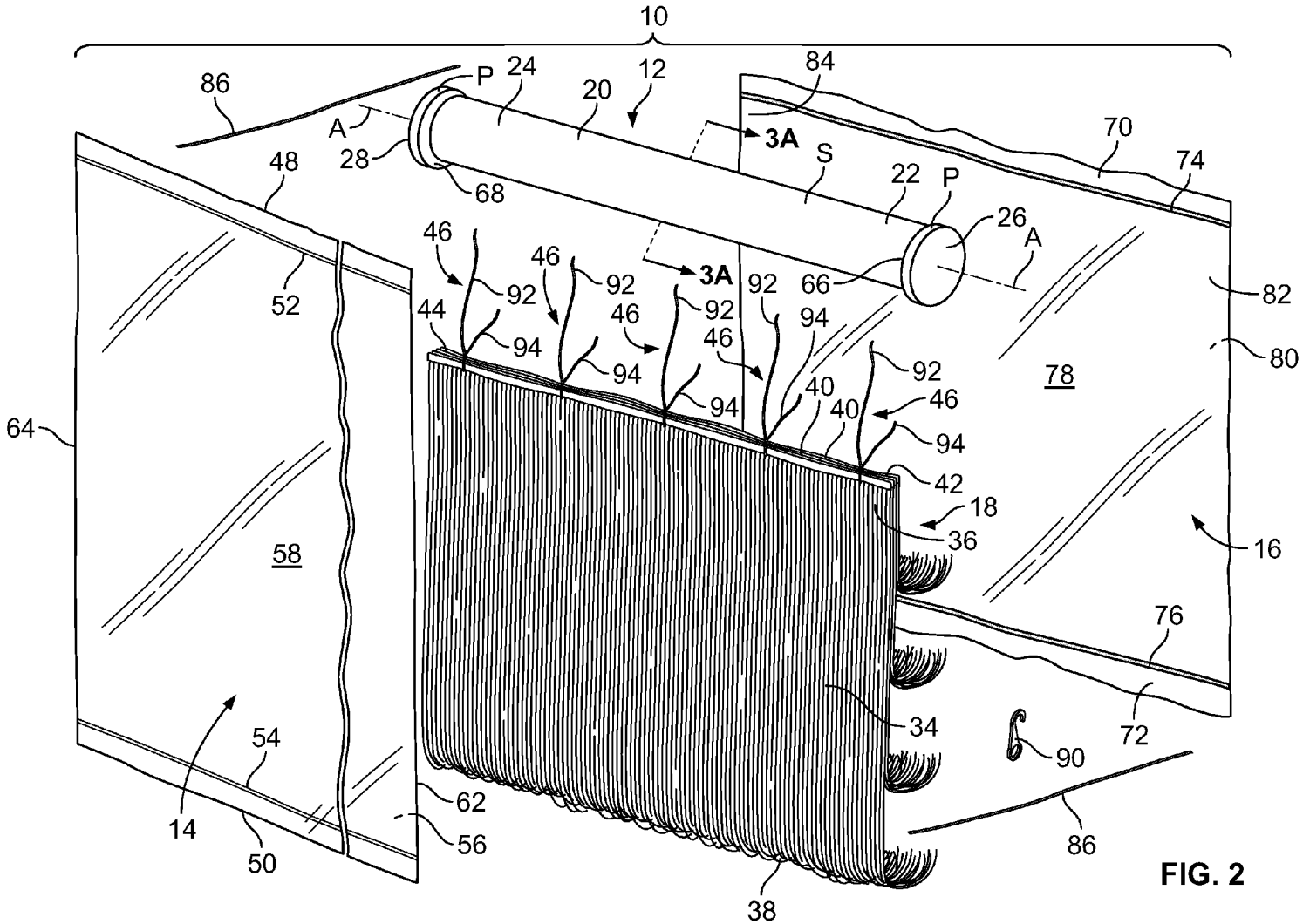
FIG. 2 is an exploded view of the hair packaging shown in FIG. 1.

Referring to FIG. 2, the base 12 includes an elongated rod 20 having a pair of opposing ends 22, 24. More particularly, the rod 20 is elongated along a longitudinal axis A-A. End pieces 26, 28 are removably or fixedly attached to the ends 22, 24, respectively, of the rod 20. The end pieces 26, 28 can be formed as components separate from the rod 20 and attached to same in a conventional manner (e.g., with the use of pins, staples, glue, etc.). Alternatively, the end pieces 26, 28 can be formed with the rod 20 as a single integral or monolithic piece (e.g., the end pieces 26, 28 and the rod 20 can be molded as a single piece). The end piece 26, 28 and the rod 20 can be formed from any suitable materials, including expanded rigid polystyrene plastic materials (e.g., the material sold under the trademark STYROFOAM), other plastic or rubber materials, papers, etc.

Figure 3:
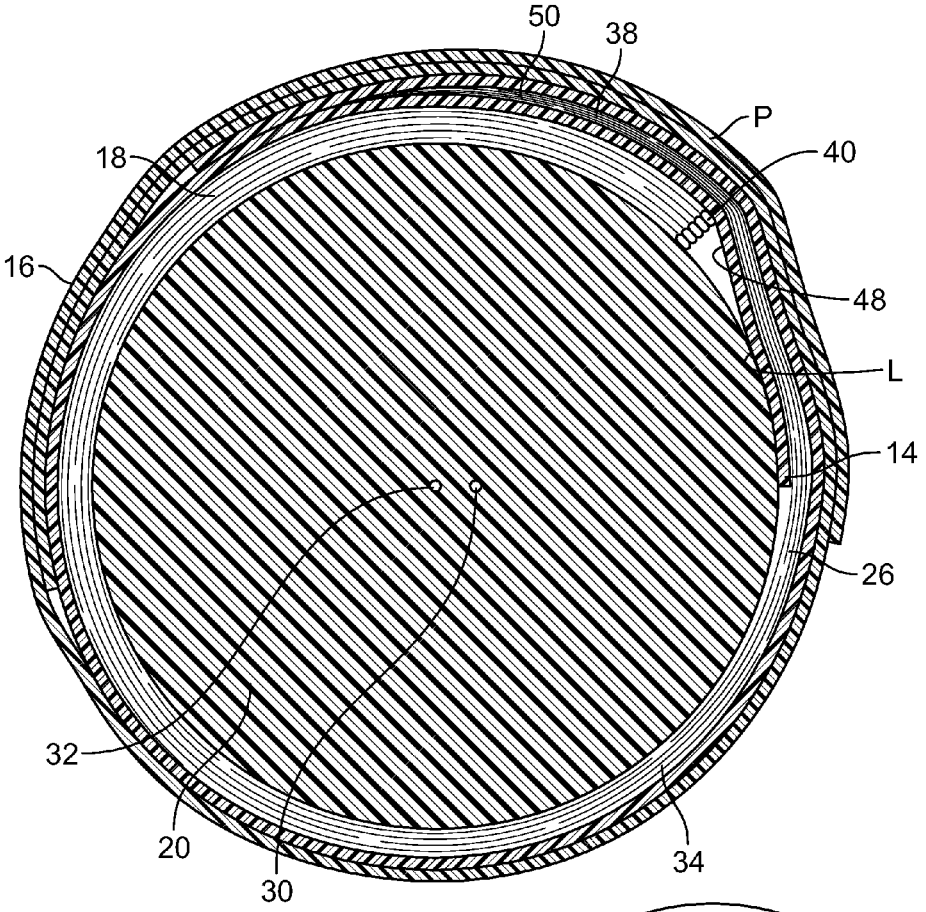
FIG. 3 is a cross-sectional view, taken along section line 3-3 and looking in the direction of the arrows, of the hair packing shown in FIG. 1.
Figure 3A:
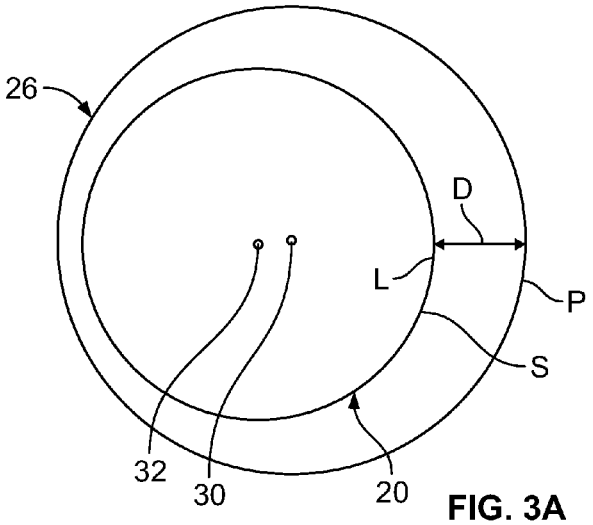
FIG. 3A is a cross-sectional view, taken along section line 3A-3A and looking in the direction of the arrows, of a base of the hair packing shown in FIG. 2.

Referring to FIGS. 2 and 3A, each the end pieces 26, 28 has a diameter greater than a diameter of the rod 20 so as to retain the hair extensions 18 therebetween when the hair extensions 18 are attached to the rod 20. In one embodiment, the end pieces 26, 28 are attached to the rod 20 such that they are off-center relative to the rod 20. That is, the center axis 30 of each of the end pieces 26, 28 is offset relative to the center axis 32 of the rod 20. In this manner, the base 12 is provided with an angular location L on the rod 20 where the depth D (i.e., the distance measured between the outer perimeters P of the end pieces 26, 28 and the outer surface S of the rod 20) is greater than depths at other angular locations on the rod 20 (see FIG. 3A). In another embodiment, the end pieces 26, 28 and the rod 20 are attached to each other such that they are coaxial (i.e., the center axes 30 of the end pieces 26, 28 are substantially aligned with the center axis 32 of the rod 20). While each of the end pieces 26, 28 and the rod 20 has a generally cylindrical cross-sectional shape (see FIG. 3), it can be provided any suitable shape, such as an oval, round, rectangular or hexagonal shape. The end pieces 26, 28 and the rod 20 can also have any suitable size.

Figure 4:
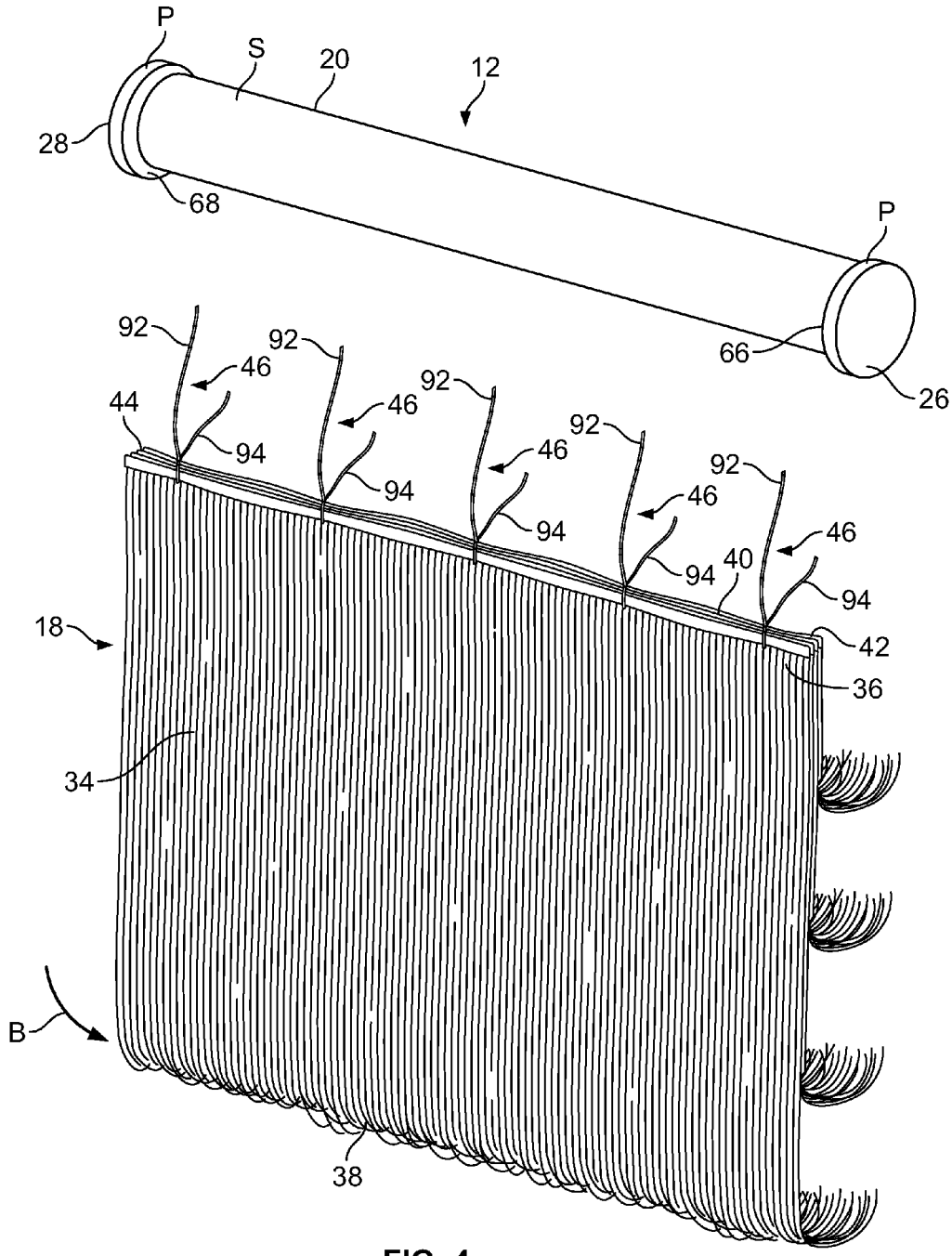
FIGS. 4-8 are sequential schematic views illustrating a process for assembling the hair packaging shown in FIG. 1.

Now referring to FIGS. 2 and 4, the hair extensions 18 are packaged in the packaging 10 such that they are wrapped or wound around the rod 20 of the base 12. More particularly, each of the hair extensions 18 is constructed in basically the same manner as conventional hair extensions, such as hair extensions sold by Shake-N-Go Fashion, Inc., Port Washington, N.Y., under the trademark MILKYWAY. For instance, each of the hair extensions 18 includes a plurality of hair strands 34, each of which has a proximate end 36 and a distal end 38. The proximal ends 36 of the hair strands 34 are sewn or otherwise attached to a weft or strip 40 in a conventional manner such that the hair strands 34 depend from a corresponding one of the wefts 40. The weft 40 of each of the hair extensions 18 has a pair of opposing ends 42, 44, between which the hair strands 34 are attached.

Referring to FIGS. 3 and 4, the wefts 40 of the hair extensions 18 are ganged together, and tied to each other and removably applied widthwise to the rod 20 with a plurality of ties 46. More particularly, each of the ties 46 ties the wefts 40 of the hair extensions 18 to each other and is tied around the rod 20 to removably attached the wefts 40 and hence the hair extensions 18 to the rod 20. The wefts 40 of the hair extensions 18 are positioned adjacent the location L on the rod 20. Since the depth D at the location L is sufficient so as to accommodate the overall thickness of the wefts 40, the wefts 40 do not bulge outwardly in a radial direction substantially beyond the outer perimeters P of the end pieces 26, 28. With the wefts 40 attached to the rod 20, the hair strands 34 are wrapped or wound around the rod 20 and are maintained in their wrapped-around orientation by the inner wrap 14, as will be discussed in greater detail below.

In one embodiment, the hair strands 34 of each of the hair extensions 18 are provided a generally curled shape. In another embodiment, only the distal ends 38 of the hair strands 34 of each of the hair extensions 18 are curled generally in the same direction, the rest of the hair strands 34 being generally straight. In yet another embodiment, the entire hair strands 34 may be provided with a generally straight shape.

With reference to FIG. 4, the hair extensions 18 may be provided different hair strand lengths. That is, the lengths of the hair strands 34 of each of the hair extensions 18 may be substantially different from those of the other hair extensions 18. For instance, the hair strands 34 of one of the hair extensions 18 may generally be two inches long, the hair strands 34 of a second one of the hair extensions 18 may generally be four inches long, the hair strands 34 of a third one of the hair extensions 18 may generally be six inches long, and so on. In this manner, hair extensions of different hair lengths can be provided to an end user in a single package. When the hair extensions 18 are each provided with a different hair length, the hair extensions 18 are arranged in the order of hair lengths such that the one with the shortest length is positioned closest to the rod 20, while the one with the longest hair length is positioned farthest away from the rod 20 (see FIG. 5). The order of positions of the hair extensions 18 relative to the rod 20 can be changed in any suitable manner.

In an alternate embodiment, the hair extensions 18 may be provided with a similar hair strand length. That is, the lengths of the hair strands 34 of each of the hair extensions 18 may be substantially identical to those of the other hair extensions 18 (e.g., the hair strands 34 of each of the hair extensions 28 are generally 10 inches long).

Figure 7:
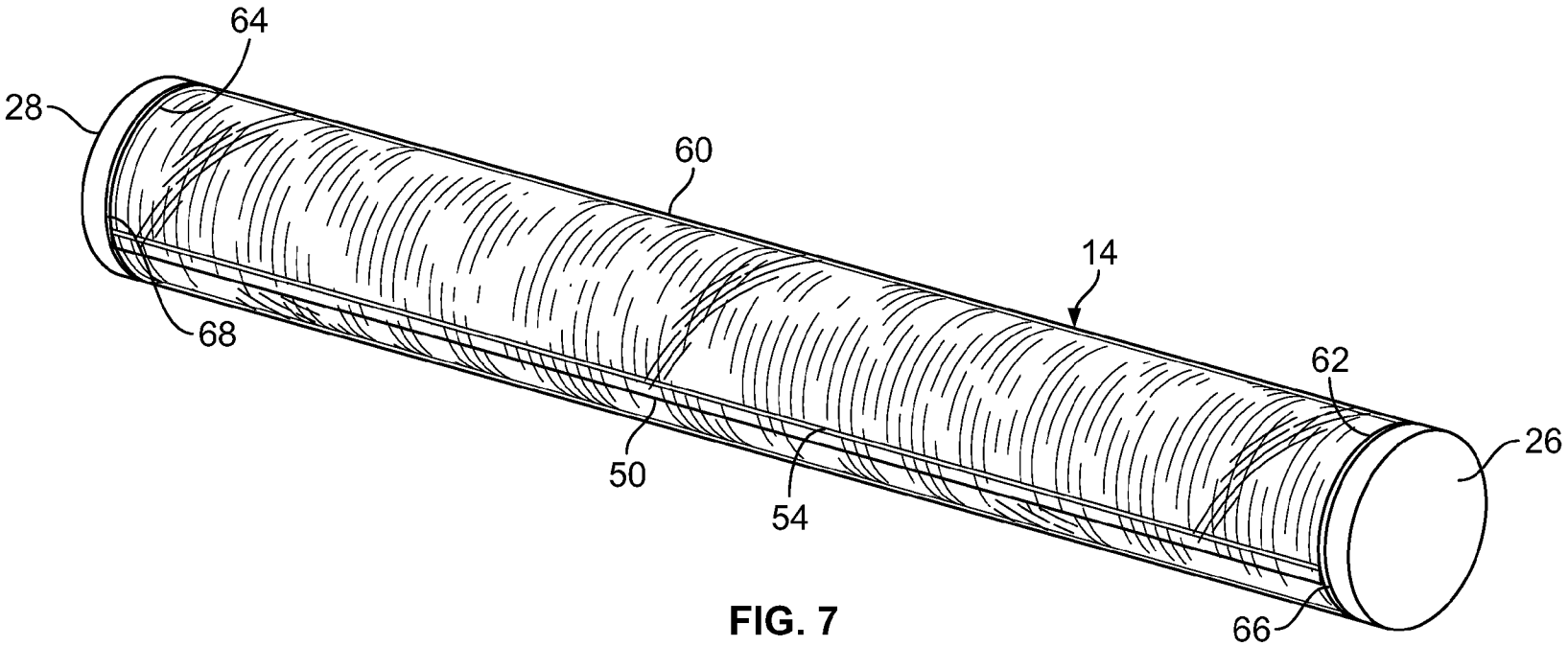

With reference to FIGS. 2, 3 and 7, the inner wrap 14 is adapted to wrap or wind around the rod 20 for maintaining the hair extensions 18 wound around the rod 20. More particularly, the inner wrap 14 includes a pair of opposing sides 48, 50 and adhesive strips 52, 54 adjacent the sides 48, 50, respectively, on an inner surface 56 of the inner wrap 14, which faces the rod 20. The side 48 of the inner wrap 14 is attached directly to the rod 20 via the adhesive strip 52, while the side 50 of the inner wrap 14 wraps over a portion thereof (e.g., the side 48) and is attached to an outer surface 58 of the inner wrap 14 via the adhesive strip 54, thereby forming an generally cylindrical sleeve 60 (see FIG. 7) around the hair extensions 18. The inner wrap 14, which includes opposing ends 62, 64, has a width that is slightly smaller than the distance between inner sides 66, 68 of the end pieces 26, 28, respectively, such that the sleeve 60 (i.e., the inner wrap 14) is captured between the end pieces 26, 28. That is, the ends 62, 64 of the inner wrap 14 do not extend outwardly beyond the inner sides 66, 68, respectively, of the end pieces 26, 28, respectively. In one embodiment, the diameter of the sleeve 60 is smaller than the diameter of each of the end pieces 26, 28 such that the sleeve 60 is maintained over the rod 20 and the hair extensions 18 and is prevented from falling off the rod 20 and causing the hair extensions 18 to unravel.

Now referring back to FIGS. 2 and 3, the outer wrap 16 is adapted to wrap around the assembly of the rod 20, the hair extensions 18 and the inner wrap 14. More particularly, the outer wrap 16 includes a pair of opposing sides 70, 72 and adhesive strips 74, 76 adjacent the ends 70, 72, respectively, on an inner surface 78 of the outer wrap 16 facing the inner wrap 14. The side 70 of the outer wrap 16 is attached directly to the outer surface 58 of the inner wrap 14 via the adhesive strip 74, while the side 72 of the outer wrap 16 warps over a portion thereof and is attached to an outer surface 80 of the outer wrap 16 via the adhesive strip 76. The outer wrap 16 is provided with a sufficient width such that it has end portions 82, 84 extending beyond the end pieces 26, 28 of the base 12 (see FIGS. 1 and 8). A tie 86 is tied round each of the end portions 82, 84 so as to clamp down on the end portions 82, 84 and form a knot 88 on a corresponding one of the end portions 82, 84, thereby enclosing the base 12, the hair extensions 18 and the inner wrap 14 within the outer wrap 16. A hook 90 (see FIGS. 1 and 2) is secured to the knot 88 formed on the end portion 82 such that the packaging 10 can be hung from a display hook (not shown). In this manner, the packaging 10 can be displayed in a substantially vertical orientation.

The inner and/or outer wraps 14, 16 can be made from any suitable materials (e.g., plastic, paper, metallic foil, fabric, etc.). In one embodiment, each of the inner and outer wraps 14, 16 is made from a transparent or translucent plastic sheet in its entirety such that the hair extensions 18 packaged within the packaging 10 can be viewed by an end user. In an alternate embodiment, the inner wrap 14 can be made from a netting material.

Referring to FIGS. 4-8, a process for assembling or making the packaging 10 will be discussed hereinbelow. Initially, the hair extensions 18 are gathered and assembled together for attachment to the base 12 (see FIG. 4). More particularly, the wefts 40 of the hair extensions 18 are ganged together and releasably secured to one another with the ties 46. Other conventional securing mechanisms, such as clamps, etc., may be used for securing the wefts 40 to each other. In one embodiment, the ties 46 are roped around the wefts 40 at selected locations along the widths thereof. Each of the ties 46 has a sufficient length such that after it is tied around the wefts 40, it has free end portions 92, 94 for purposes to be discussed below (see FIG. 4). When the hair strands 34 of the hair extensions 18 are provided with a curled shape, the hair extensions 18 are assembled together such that the hair strands 34 curl generally in the same direction (as indicated by arrow B in FIG. 4).

Figure 5:
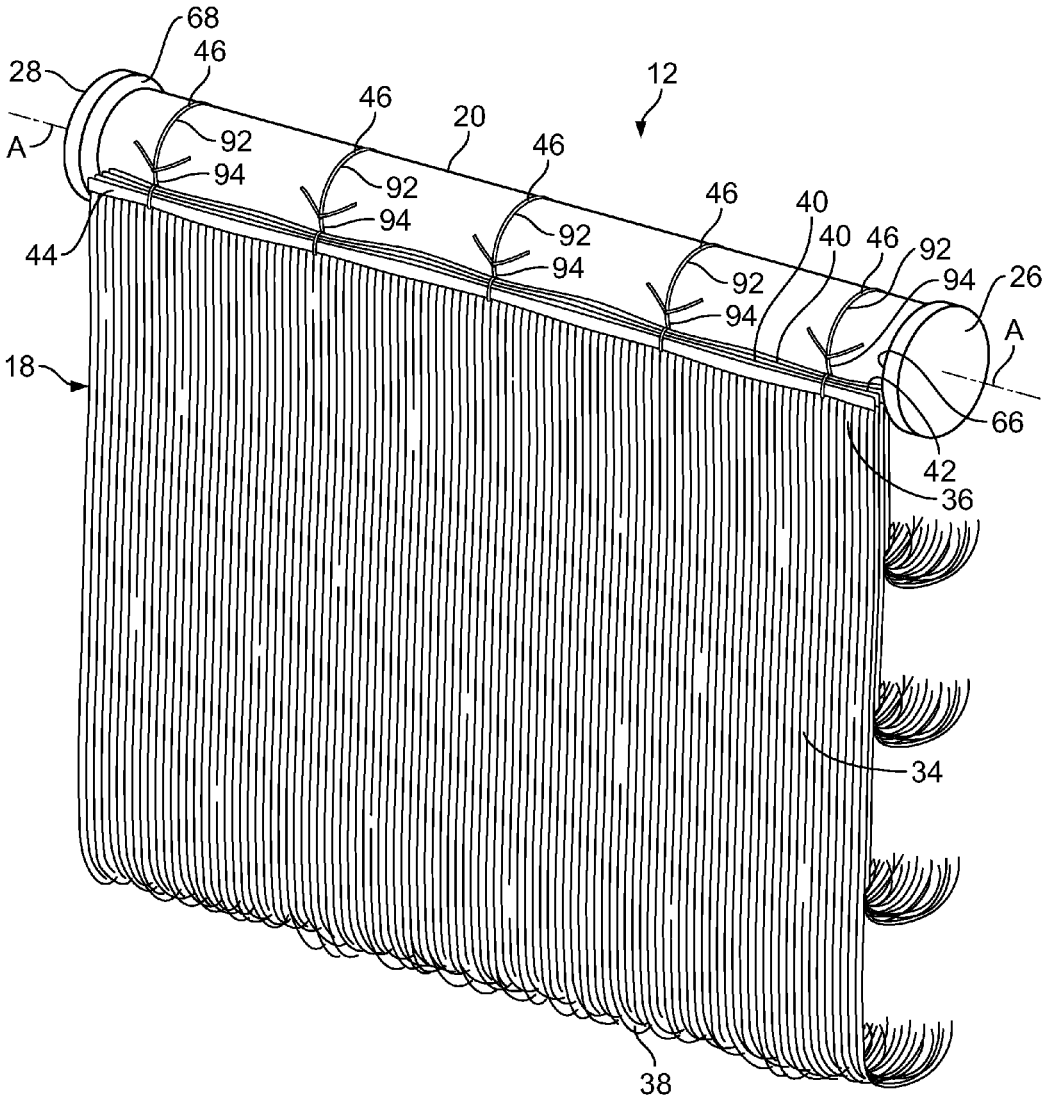

Once the hair extensions 18 are properly assembled and secured to each other, the wefts 40 of the hair extensions 18 are applied widthwise to the rod 20 such that the wefts 40 are oriented generally parallel to the longitudinal axis A-A of the rod 20 (see FIG. 5). Thereafter, the free end portions 92, 94 of each of the ties 46 are wrapped around the rod 20 and then tied to each other so as to removably secure the wefts 40 and hence the hair extensions 18 to the rod 20 (see FIG. 5). In one embodiment, the wefts 40 are secured adjacent the angular location L on the rod 20, the depth D at which location is sufficient enough to accommodate the overall thickness of the wefts 40 (see FIGS. 3 and 3A). In this manner, the ganged-together wefts 40 do not bulge out substantially beyond the outer perimeters P of the end pieces 26, 28. In another embodiment, the wefts 40 may be attached to the rod 20 at any angular location.

Figure 6:
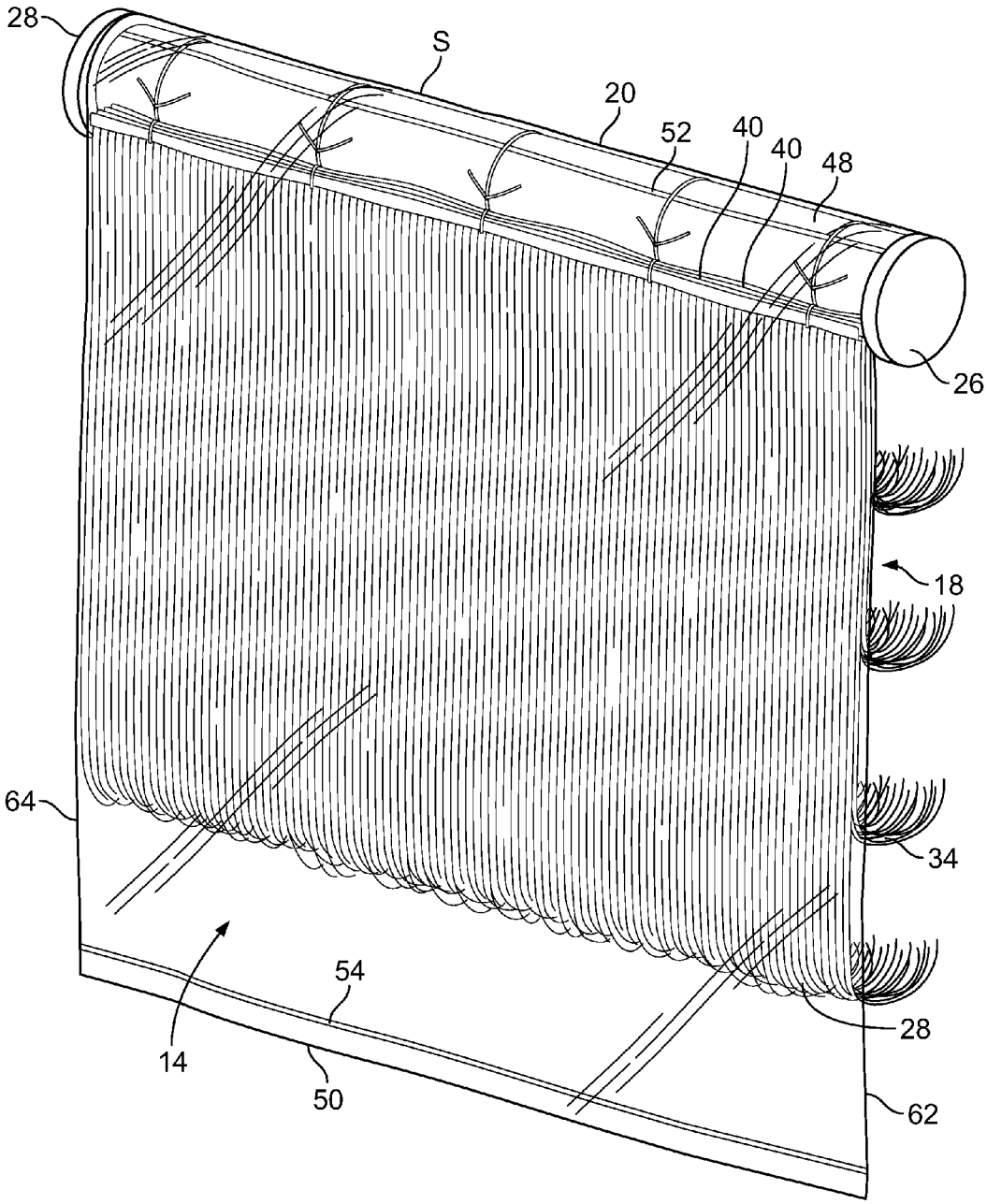

Referring now to FIG. 6, after properly tying the wefts 40 to the rod 20, the inner wrap 14 is applied over the hair extensions 18. More particularly, the side 48 of the inner wrap 14 is attached directly to the rod 20 via the adhesive strip 52 such that the rest of the inner wrap 14 depends from the rod 20 and covers the hair extensions 18, which also depend from the rod 20. The inner wrap 14 is provided with a length (i.e., the distance between the sides 48, 50 of the inner wrap 14) that is greater than the length of the hair strands 34 of the hair extensions 18 such that the side 50 of the inner wrap 14 extends beyond the distal ends 28 of the hair extensions 18. The inner wrap 14 and the hair extensions 18 are wrapped together around the rod 20 substantially about its central axis 32 (see FIG. 3). If the length of the hair strands 34 of any of the hair extensions 18 is greater than the circumference of the rod 20, then the distal ends 38 of the hair strands 34 would extend over the side 48 and the portion of the inner wrap 14 covering the wefts 40 and the hair extensions 18 in a first turn or wrap around the rod 20. As a result, the distal ends 38 of the hair strands 34 do not come in direct contact with, and are thereby prevented from tangling with, the wefts 40 and the underlying hair strands 34. If the hair strands 34 are long enough to make two or more turns around the rod 20, the inner wrap 14 is layered between the hair strands 34 in each turn around the rod 20 and the hair strands 34 in a subsequent or preceding turn. As a result, the hair strands 34 in each turn is prevented from coming in contact, and tangling, with the hair strands 34 in a subsequent or preceding turn (see FIG. 3). In an alternate embodiment, the hair strands 34 of one or more or all of the hair extensions 18 are provided with lengths smaller than the circumference of the rod 20 such that they do not make a complete turn around the rod 20.

After the inner wrap 14 and the hair extensions 18 are tightly wound around the rod 20, the side 50 of the inner wrap 14 is removably attached to the outer surface 58 of the inner wrap 14 via the adhesive strip 54 (see FIG. 7). The substantially cylindrical sleeve 60 is thereby formed around the hair extensions 18 so as to keep same wrapped around the rod 20. Due to the curved outer surface S of the rod 20 (e.g., a cylindrically shaped surface), the hair strands 34 are able to maintain their curved shapes while packaged within the packaging 10 (see FIG. 3).

Figure 8:
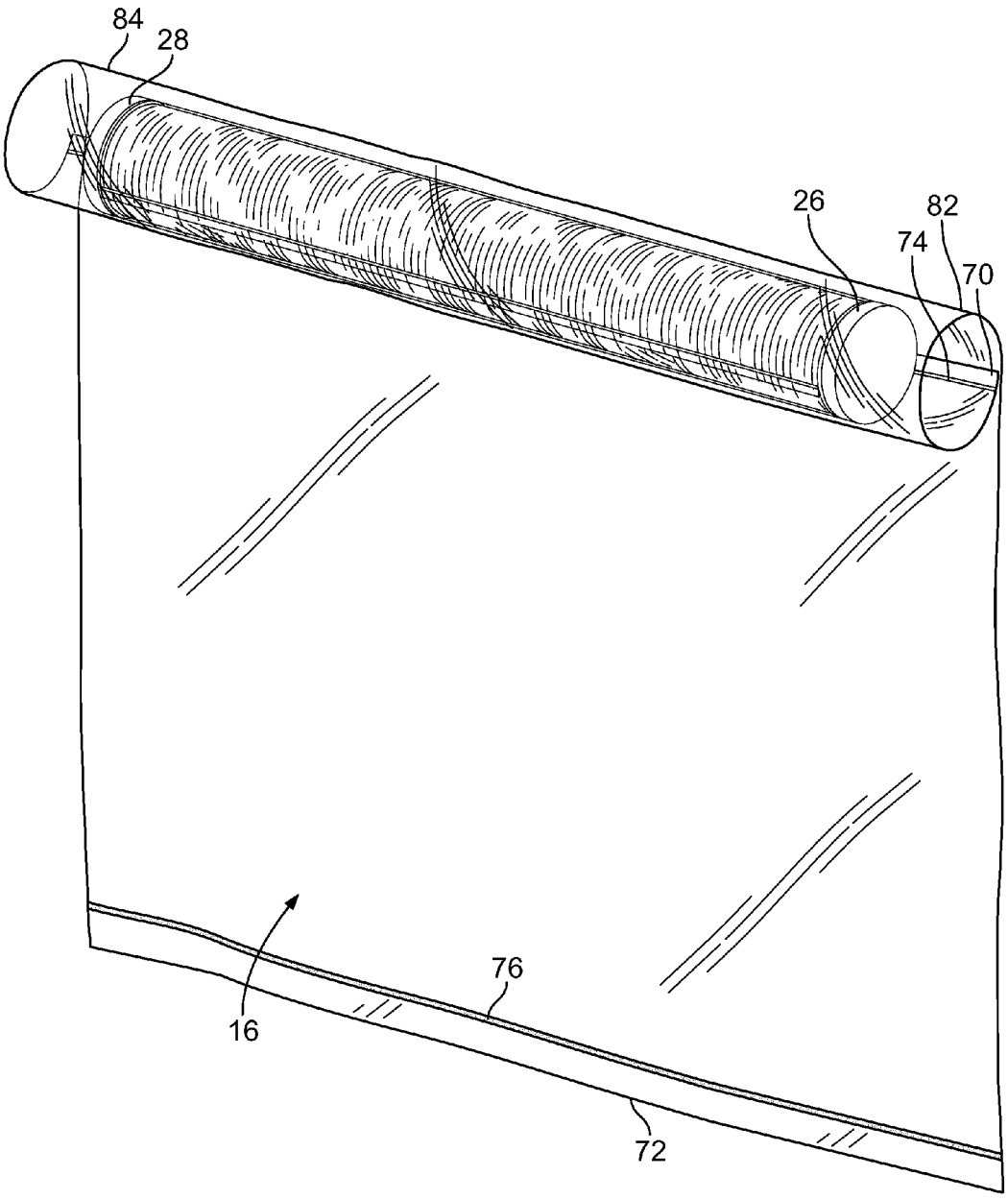

Now referring to FIG. 8, the side 70 of the outer wrap 16 is applied to the inner wrap 14 and removably attached to same via the adhesive strip 74. Thereafter, the outer wrap 16 is wound around the assembly of the base 12, the hair extensions 18 and the inner wrap 14, and the opposite side 72 of the outer wrap 16 is secured to the outer wrap 16 via the adhesive strip 76, forming a substantially cylindrical outer cover 96 (see FIG. 1). Each of the end portions 82, 84 of the outer wrap 16, which extend beyond the end pieces 26, 28, respectively, is clamped down with a corresponding one of the ties 86 so as to contain the assembly of the base 12, the hair extensions 18 and the inner wrap 14 within the cylindrical outer cover 96.

The hook 90 is optionally attached to the tie 86 at the end portion 82 such that the packaging 10 can be hung in a vertical orientation. When the packaging 10 is hung in its vertical orientation, the knot formed at the end portion 84 of the outer wrap 16 (not shown, but similar to the knot 88 formed at the end portion 82) keeps the base/hair extension/inner wrap assembly from slipping off the outer cover 96. Moreover, the cylindrical sleeve 60 and the end piece 28 of the base 12 cooperate with one another so as to prevent the hair strands from falling off the rod 20 and to thereby maintain same in their rolled-up condition, hence facilitating the preservation of the curls provided in the hair extensions 18 while the packaging 10 is hung in its vertical orientation. In an alternate embodiment, the packaging 10 may be displayed in a horizontal orientation.

It should be noted that the present invention can have various numerous modifications and variations. For instance, the base 12 may have an elliptical, hexagonal or other suitable cross-section known in the art. In addition, the size and shape of the base 12, inner wrap 14 and outer wrap 16 may be varied to accommodate hairpieces of a variety of shapes, styles and sizes. Moreover, while the embodiment depicted in FIG. 5 utilizes five ties, one of ordinary skill in the art will recognize that any number and type of ties or fasteners may be employed. For instance, in other embodiments, the hair extensions 18 may be attached to the rod 20 by an adhesive, clasp, strings or other suitable attachment mechanisms known in the art.

When hair extensions having a number of different hair lengths are provided, they can be packaged in two or more hair packages, each of which has a construction and assembly basically identical to those of the packaging 10. For instance, one of such hair packages may contain hair extensions having 4-inch, 6-inch and 8-inch hair extensions, while another one of such hair packages may contain hair extensions having 10-inch, 12-inch and 14-inch hair extensions.

The rod 20 may be made from a rigid or flexible material. The rod 20 may also have any desirable shape, such as a linear, non-linear or arcuate shape. For instance, when made from a flexible material, the rod 20 may be bent to provide a C-shape, U-shape or any other desirable shape. As used herein, the term "elongate" or "elongated" as applied to the rod 20 is intended to cover all such rod shapes.

It will be understood that the embodiments described herein are merely exemplary and that a person skilled in the art may make many variations and modifications without departing from the spirit and scope of the invention. All such variations and modifications are intended to be included within the scope of the invention, as embodied in the claims presented hereinbelow.

We claim:

1. A packaging comprising an elongated member having a first end and a second end opposite said first end, said elongated member being elongated along a longitudinal axis between said first and second ends, said elongated member having a first end piece, which is located at said first end, and a second end piece, which is located at said second end; at least one hair product having a plurality of hair strands wound around said elongated member and positioned between said first and second end pieces of said elongated member, said at least one hair product including at least one strip which is secured to said elongated member and which is substantially parallel to said longitudinal axis of said elongated member, at least some of said plurality of hair strands being attached to said at least one strip and wound at least once around said elongated member; and at least one wrap wound around said elongated member over said plurality of hair strands so as to keep said plurality of hair strands wound around said elongated member.

2. The packaging of claim 1, wherein said at least one strip includes a plurality of strips assembled together and attached to said elongated member, at least some of said plurality of hair strands being attached to each of said plurality of strips.

3. The packaging of claim 2, wherein each of said plurality of hair strands extends from a corresponding one of said plurality of strips and is wound around said elongate member.

4. The packaging of claim 1, wherein each of said first and second end pieces has a diameter greater than a diameter of said elongated member so as to capture said plurality of hair strands between said first and second end pieces.

5. The packaging of claim 1, wherein said first and second end pieces are offset from a center of said elongated member so as to provide an area having a depth greater than other locations on said elongated member, said plurality of strips being attached to said area of said elongated member.

6. The packaging of claim 2, further comprising at least one fastener for securing said plurality of strips to said elongated member.

7. The packaging of claim 6, wherein said at least one fastener includes at least one tie for tying said plurality of strips to each other and for attaching said tied strips to said elongated member.

8. The packaging of claim 1, wherein said elongated member has a generally round cross-sectional shape so as to maintain curled shapes of said plurality of hair strands.

9. The packaging of claim 8, wherein said round cross-sectional shape includes a substantially circular or elliptical cross-sectional shape.

10. The packaging of claim 1, wherein said at least one wrap includes an inner wrap and an outer wrap wound about said elongated member.

11. The packaging of claim 10, wherein said inner wrap is wound about said elongated member such that said inner wrap covers said plurality of hair strands so as to keep said plurality of hair strands wound around said elongate member.

12. The packaging of claim 11, wherein said outer wrap is wound about said elongated member such that said outer wrap covers said plurality of hair strands, said inner wrap and said elongated member.

13. The packaging of claim 12, wherein said outer wrap has portions extending beyond said first and second ends of said elongated member and constricted so as to contain therein said plurality of hair strands, said inner wrap and said elongated member.

14. The packaging of claim 13, wherein each of said inner and outer wraps is made from a translucent or transparent material in its entirety such that said at least one hair product is viewable through said inner and outer wraps.

* * * * *